US007516732B2

(12) United States Patent
Hagel et al.

(10) Patent No.: US 7,516,732 B2
(45) Date of Patent: Apr. 14, 2009

(54) METHOD FOR DETECTING THE BEGINNING OF COMBUSTION IN AN INTERNAL COMBUSTION ENGINE

(75) Inventors: Reinhold Hagel, Pinzberg (DE); Mehmet Tuna, Fuerth (DE); Ernst Meyer, Weissenohe (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 298 days.

(21) Appl. No.: 10/587,929

(22) PCT Filed: Jan. 20, 2005

(86) PCT No.: PCT/DE2005/000070

§ 371 (c)(1),
(2), (4) Date: Aug. 1, 2006

(87) PCT Pub. No.: WO2005/075804

PCT Pub. Date: Aug. 18, 2005

(65) Prior Publication Data

US 2008/0127945 A1 Jun. 5, 2008

(30) Foreign Application Priority Data

Feb. 4, 2004 (DE) ..... 10 2004 005 325

(51) Int. Cl.
*F02P 5/15* (2006.01)

(52) U.S. Cl. ..... 123/406.58; 123/406.65; 123/406.59; 123/436

(58) Field of Classification Search ..... 123/336, 123/406.58, 406.59, 406.65, 436
See application file for complete search history.

(56) References Cited

U.S. PATENT DOCUMENTS

| | | | | |
|---|---|---|---|---|
| 4,513,714 | A | 4/1985 | Dolenc et al. | |
| 5,239,473 | A | 8/1993 | Ribbens et al. | |
| 5,241,480 | A | 8/1993 | Takaku et al. | |
| 5,428,991 | A | 7/1995 | Klenk et al. | |
| 5,691,469 | A | 11/1997 | Mezger et al. | |
| 5,909,724 | A | 6/1999 | Nishimura et al. | |
| 5,934,256 | A | 8/1999 | Wenzlawski et al. | |
| 6,021,758 | A | 2/2000 | Carey et al. | |
| 6,286,482 | B1 * | 9/2001 | Flynn et al. | 123/435 |

(Continued)

FOREIGN PATENT DOCUMENTS

DE 25 13 289 10/1976

(Continued)

*Primary Examiner*—Erick Solis
(74) *Attorney, Agent, or Firm*—W. F. Fasse; W. G. Fasse

(57) ABSTRACT

A method detects the beginning of combustion in an internal combustion engine (1) having several cylinders (2, 3, 4, 5), form a rotation speed signal determined for a shaft (6) of the engine (1). A segment signal (SS), whose signal length corresponds to an integral multiple of one or more full rotation of the shaft (6), is extracted from the rotation speed signal. A cylinder signal (ZS1, ZS2, ZS3, ZS4), which reproduces the operational state in a cylinder (2, 3, 4, 5), is generated from the segment signal (SS). The cylinder signal is transformed into a cylinder frequency signal (FS1, FS2, FS3, FS4) in an angular frequency range. Signal information indicating the beginning of combustion in the associated cylinder is extracted from the cylinder frequency signal at least one predefined angular frequency.

10 Claims, 2 Drawing Sheets

U.S. PATENT DOCUMENTS

| | | | |
|---|---|---|---|
| 6,318,152 | B1 | 11/2001 | Hagihara et al. |
| 6,665,607 | B2 | 12/2003 | Skala et al. |
| 2005/0229904 | A1 | 10/2005 | Hagel et al. |

FOREIGN PATENT DOCUMENTS

| | | |
|---|---|---|
| DE | 33 02 219 | 8/1983 |
| DE | 41 33 679 | 4/1993 |
| DE | 42 21 891 | 1/1994 |
| DE | 690 04 410 | 5/1994 |
| DE | 44 13 473 | 10/1995 |
| DE | 195 31 845 | 3/1997 |
| DE | 196 12 180 | 3/1997 |
| DE | 197 13 104 | 10/1997 |
| DE | 196 22 042 | 12/1997 |
| DE | 197 49 817 | 5/1999 |
| DE | 100 38 339 | 2/2002 |
| DE | 102 35 665 | 2/2004 |
| EP | 0 799 983 | 10/1997 |
| GB | 2 331 153 | 5/1999 |

* cited by examiner

METHOD FOR DETECTING THE BEGINNING OF COMBUSTION IN AN INTERNAL COMBUSTION ENGINE

FIELD OF THE INVENTION

The invention relates to a method for detecting the beginning of combustion in an internal combustion engine comprising several cylinders by means of a rotation speed signal determined for a shaft of the internal combustion engine.

BACKGROUND INFORMATION

With an in particular self-igniting internal combustion engine it may happen that the combustion in the respective cylinders does not take place at the best possible point of time. This undesired deviation is due to aging effects or manufacturing tolerances. This may result in an increase of exhaust gas discharge, a rise of fuel consumption or also a deterioration of the concentric running of the internal combustion engine.

Methods are known, which detect the exact point of time of the beginning of combustion by means of additionally provided sensors. In DE 33 02 219 A1 as well as in DE 197 49 817 A1 methods are described, which determine the march of pressure in the cylinder internal space by means of pressure sensors. Furthermore, with DE 25 13 289 A1, DE 44 13 473 A1 and DE 196 12 180 C1 methods are disclosed, which detect the impact sound at the outside of the housing of the internal combustion engine. Based on the pressure and/or impact sound signals measured in this way conclusion can be drawn to the beginning of combustion of the internal combustion engine. The sensors additionally necessary with known methods stand for considerable additional expenses.

SUMMARY OF THE INVENTION

It is the object of the invention to indicate a method of the above-described type, which permits detection of the beginning of combustion with means which are as easy as possible.

This object is achieved by a method according to the present invention, for detecting the beginning of combustion in an internal combustion engine having several cylinders, from a rotation speed signal determined for a shaft of the internal combustion engine, in which

- at least one segment signal, whose signal length corresponds to an integral multiple of one or more full rotations of the shaft, is extracted from the rotation speed signal, so that each cylinder ignites one time in the rotation angle range represented by the signal length,
- a cylinder signal, which substantially reproduces the operational state in one of the cylinders, is generated from the segment signal,
- the cylinder signal is transformed into a cylinder frequency signal in an angular frequency range,
- a signal information indicating the beginning of combustion in the associated cylinder is extracted from the cylinder frequency signal at at least one predefined angular frequency with regard to amplitude and phase values associated with the predefined annular frequency, and
- the beginning of combustion is detected from the signal information.

As a rule, the method according to the invention can do without any additional sensor technology. As a measured it is based merely on the rotation speed signal, which, as a rule, is detected anyway and thus is already available in a control device of the internal combustion engine. Beyond this, the exact beginning of combustion can be easily detected on the basis of the cylinder signal transformed into the angle frequency range. For this purpose no extensive arithmetic operations occur. For transformation into the angle frequency range it can be reverted, if necessary, to signal transformation methods anyway existing in the control device.

Special embodiments of the method according to the invention become apparent from the dependent claims.

The objects of two further embodiment details each concern an advantageous method for generating the cylinder signal, which contains the information to be evaluated of the currently relevant cylinder.

Further embodiments concern favorable possibilities for signal improvement, which are performed in particular before transformation into the angle frequency range. By means of these upstream method steps the beginning of combustion can be determined even more exactly, since in this case also the signal information, which can be taken in the angle frequency range and which is relevant in this regard, can be determined with higher accuracy. In accordance with another embodiment, the operational behavior of the internal combustion engine can be improved by using the detected exact beginning of combustion for (post-)regulating the concerned cylinder. The inadequacies initially described can then be largely avoided.

BRIEF DESCRIPTION OF THE DRAWINGS

Preferred example embodiments as well as further advantages and details of the invention will now be described in conjunction with the drawings. For clarification the drawing is not drawn to scale and certain aspects are shown only schematically, in which:

In FIGS. 1 and 2 like elements refer to identical reference numerals.

DETAILED DESCRIPTION OF EXAMPLE EMBODIMENTS OF THE INVENTION

Figure 1:
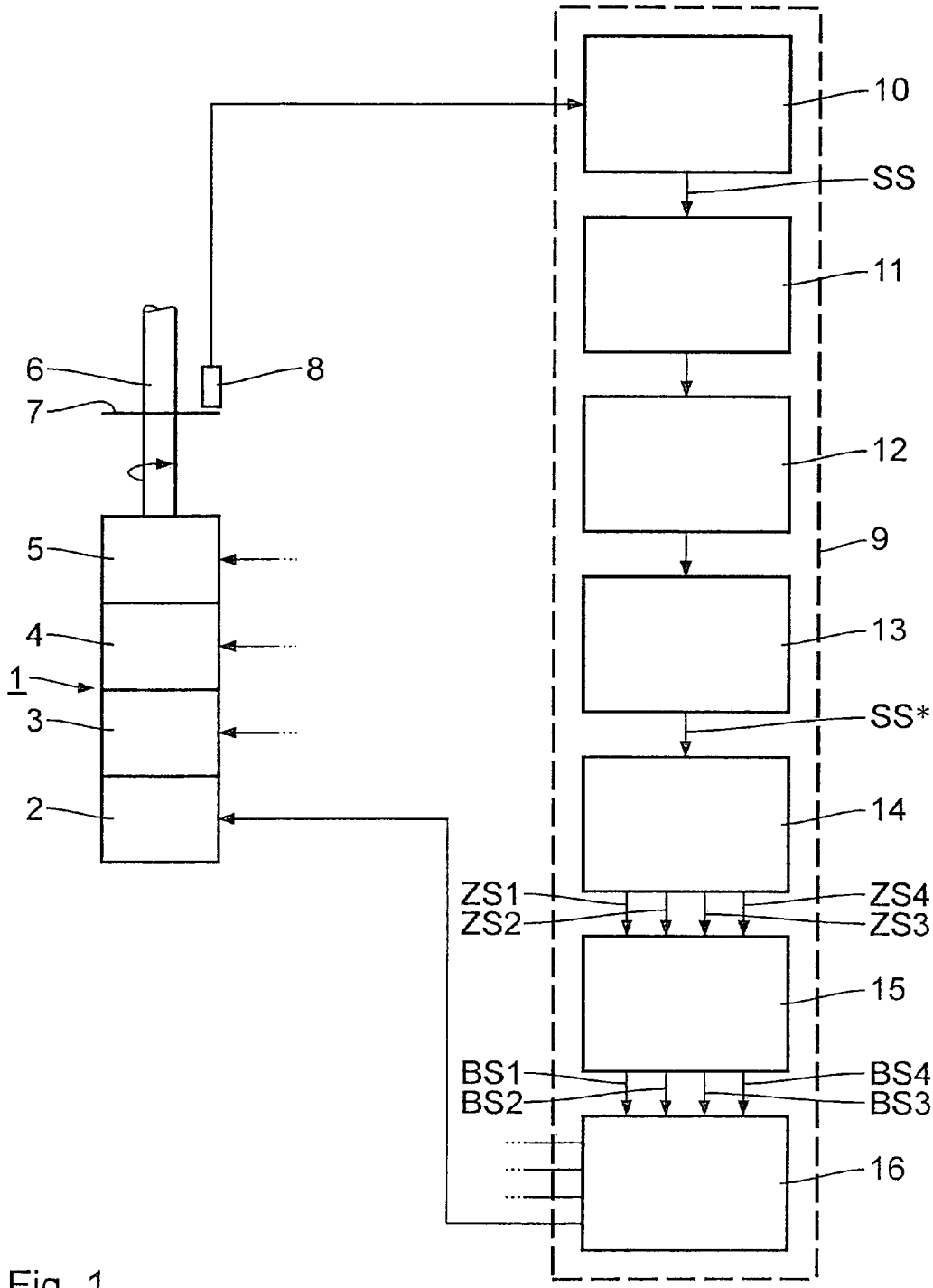
FIG. 1 shows a first example of embodiment of the method for detecting the beginning of combustion and FIG. 2 shows a second example of embodiment.

The first example of embodiment shown in FIG. 1 serves for detecting the beginning of combustion of an in particular self-igniting internal combustion engine 1, which comprises four cylinders 2, 3, 4 and 5. However, the number of cylinders is only exemplary. The method can also be applied to an internal combustion engine 1 with a different number of cylinders. A transmitter wheel 7 is mounted to a shaft 6, in particular the crank shaft, of the internal combustion engine 1, which comprises equidistant markings distributed along its circumference. These markings not shown in detail in the example of embodiment can be formed for example in the shape of teeth or even holes. A sensor 8 associated with the transmitter wheel 7, for example in the form of an inductive transmitter, supplies a signal exactly at that moment, at which one of the markings moves along the sensor 8. This signal is supplied to a control device 9.

Apart from other units not shown the control device 9 comprises also sub-units determined for detecting the beginning of combustion. These are a rotation speed unit 10, an averaging unit 11, a transmitter wheel correction unit 12, a signal reconstruction unit 13, a segmentation unit 14, an analysis unit 15 and a controller 16. These sub-units can be available physically separated, e.g. as separate electronic sub-assemblies or also combined to a single physical unit. The latter is possible on a signal processor particularly in case of a program technical implementation of the sub-units 10 to 16. A mixed form is also possible.

In the following the functioning of the detection of the beginning of combustion and its post regulation are described more detailed. The time domain signal delivered by the sensor 8 is converted in the rotation speed unit 10 into a rotation speed signal, which—as is usual with the control of internal combustion engines—refers to the rotation angle range. Depending on the rotation angle of the shaft 6 the rotation speed signal indicates the respective current shaft rotation speed or the shaft rotation acceleration.

Subsequently, a segment signal SS with a rotation angle range is extracted from the rotation speed signal, within which each of the cylinder 2 to 5 ignites exactly one time. In case of the example of embodiment this is a segment that corresponds to a duplicate full rotation of the shaft 6, i.e. with a 720 degree rotation angle range. However, depending on the type of the internal combustion engine 1 or on the shaft 6 used for detecting the rotation speed signal, which instead of the crank shaft could be formed also as a camshaft, the rotation speed range of the segment signal SS basically can de differently sized.

At present, detection of the rotation speed signal and also of the segment signal takes places practically in each control device 9 of an internal combustion engine 1. Consequently, these are no detecting means provided separately for the detection of the beginning of combustion.

The method steps described in the following always start from the existence of a quasi stationary operational state of the internal combustion engine 1.

The method steps, which are taken in the averaging unit 11, in the transmitter wheel correction unit 12 and in the signal reconstruction unit 13 are optional. They serve for improving the signal quality of the segment signal SS. In the end, the higher its quality, the more exactly the beginning of combustion can be determined.

In the averaging unit 11 the arithmetic mean value of two or more successive segment signals SS is formed. By means of this in particular cyclical variations, which come for instance from an unsteady combustion, can be eliminated.

Due to mechanical manufacturing tolerances, inaccuracies may occur in the markings arranged on the transmitter wheel 7. Thus, these markings cannot be located at equidistant distances from each other. The inaccuracies caused hereby in the segment signal SS can be eliminated on the basis of known correction methods. In DE 41 33 679 A1, DE 42 21 891 C2 and DE 196 22 042 C2 such correction methods are described. Here, correction values are detected, which are stored in the control device 9, and by means of which the rotation speed signal and also the segment signal can be freed of the mentioned transmitter wheel errors.

A further possibility for signal improvement is to use a signal reconstruction method. The markings on the transmitter wheel 7 are usually located at rotation angle distances of 6 degrees or even 10 degrees. Here, however, the rotation speed of the shaft 6 is scanned too inaccurately for some applications. Present established applications, such as for example smoothness control or also combustion beginning control work more efficiently if a higher scanning rate is available. Use of the transmitter wheel 7 with a larger number of markings, however, is not unproblematic, with an increasing number of markings the clear space between the individual markings diminishes and thus the risk of contamination or soiling increases. A possible consequence would be that individual markings may be missed or ignored.

Nevertheless, however, the scanning rate can be increased by means of certain methods of digital signal processing. A first possibility is an interpolation in the rotation angle range between the scanning values determined by the scanning rate of the transmitter wheel 7. Apart from a simple linear interpolation in particular also a Lagrange-interpolation or a sinc-interpolation is suitable. The Lagrange-interpolation, which is especially advantageous in this respect, is a special polynomial interpolation method. Compared to other interpolation polynomials of a higher rank, which basically can also be used, the Lagrange-interpolation is advantageous in that it can do without the solution of a relatively complex system of equations. The sinc-interpolation is based on a mathematic convolution operation.

In the example of embodiment, with a periodical and band-limited signal the Lagrange-interpolation as well as the sinc-interpolation deliver an exact signal reconstruction to the segment signal SS, while taking into consideration the scanning theorem, whereby they differ advantageously from a linear and also from another higher-graded polynomial interpolation.

A second possibility for increasing the scanning rate is a frequency transformation of the segment signal into the angle or angular frequency domain. This transformation is performed in particular by means of a discrete Fourier-Transformation (DFT) or a discrete Hartley-Transformation (DHT). Unlike the Fourier-Transformation, the Hartley-Transformation beneficially carries out only purely real operations. This results in a lower computing burden or expenditure. Both transformations each respectively provide an amplitude value and a phase value for discrete angle frequencies, which in the field of internal combustion engines are also called orders. A continuous reconstruction signal for the segment signal SS results on the basis of a superposition of harmonic partial vibrations of those orders (=angle frequencies), for which in the angle frequency range relevant spectral portions, i.e. amplitude and phase values, have been determined. In this regard, the individual harmonic partial vibrations are weighted with the respective associated amplitude and phase value. In this manners, while complying with the scanning theorem, and exact reconstruction of the segment signal SS is possible, as far as the basic underlying signal is periodic and band-limited.

The interpolation as well as the frequency transformation method deliver a reconstructed signal, which exists in form of an analytic functional printout. From this the required functional value can be taken at any places in the rotation angle region, i.e. in particular also between the metrologically determined scanning places. This results in the desired higher scanning rate. Thus, from a segment signal SS with an original scanning rate of 10 degrees a modified segment signal with an arbitrary higher scanning rate, e.g. with a 0.1 degree-scanning, can be generated.

The particularly advantageous Lagrange-interpolation method as well as the mentioned Frequency-Transformation method (DFT, DHT) can be realized as so-called FIR-filter (=finite impulse response). Basically, however, also other forms of implementation are possible.

After having passed through the sub-units 11, 12 and/or 13 provided for signal improvement an improved segment signal SS* is available, which indicates the information on the beginning of combustion in the cylinders 2 to 5.

In the segmentation unit 14 the improved segment signal SS* is decomposed into a total of four cylinder signals ZS1, ZS2, ZS3 and ZS4. Each cylinder signal ZS1 to ZS4 then merely indicates the information on ignition in a single cylinder. In doing so, in the present example of embodiment the cylinder signals ZS1 to ZS4 can detect an angle range of up to 180 degrees. However, from the improved segment signal SS* an extraction of cylinder signals ZS1 to ZS4 is favorable, which comprise only an angle range, within which the actual ignition process effectively takes place in the respective cylinder 2 to 5, i.e. in particular the range lying respectively around the top cylinder dead center. For this purpose, for example a rotation angle range of approx. 40 to 50 degrees is sufficient.

The cylinder signals ZS1 to ZS4 determined in this way are supplied to the analysis unit 15, which performs for each cylinder signal ZS1 to ZS4 a frequency transformation into the angle frequency range. This, in turn, can happen by means of a DFT, a DHT or a digital filtering, for example in form of a digital bandpass-filtering with variable mid-frequencies or in form of digital filter banks. This transmission into the angle frequency range produces from the cylinder signals ZS1, ZS2, ZS3 and ZS4 respectively associated cylinder frequency signals FS1, FS2, FS3, respectively FS4. In this case, for the latter, in turn, amplitude values and phase values with associated discrete angle frequencies are available.

This signal information, i.e. the angle frequencies plus their associated amplitude and phase values, indicate the information included in the basic respective cylinder signal ZS1 to ZS4 on the operational state in the respective cylinder 2 to 5. In particular, from this signal information also the exact beginning of combustion in the respective cylinder 2 to 5 can be taken in easy manner. This can take place by means of a comparison with for example empirical experience values or also with reference values determined in advance. The experience and/or reference values are preferably deposited in the analysis unit 15. It can also be reverted to the signal information of the particularly signal-strong angle frequencies. For this purpose preferably those angle frequencies come into question, for which the amplitude value lies above a threshold, in particular above the 3 dB-threshold. The signal information, preferably the phase information, of the special angle frequency thus determined is then made available as the combustion beginning signal BS1, BS2, BS3 and BS4 of the analysis unit 15 reproducing the beginning of combustion in the respective cylinder 2 to 5.

The combustion signals BS1 to BS4 are supplied to a controller 16, which uses the included information on the beginning of combustion for (post-)regulation of the respective cylinder 2 to 5, at least as far as this is still categorized as admissible by a higher-ranking controller limitation possibly available. The (post-) regulation can take place for example by means of a variation of the starting output at a fuel-injection pump of the internal combustion engine 1 not shown in detail. In particular the regulation can be performed on the basis of at least one load and/or rotation speed dependent phase-starting output-curve family. Hereby, individually for each of the cylinders 2 to 5 the beginning of combustion is adjusted to the optimum point of time. This is possible in particular without substantial additional hardware components becoming necessary in the control device 9 or at the internal combustion engine 1 for the above-described method. Particularly no additional detection of special operating parameters of the internal combustion engine 1 is necessary. This results in a very cost-efficient realization for the detection of the beginning of combustion and for the cylinder-individual post regulation of the point of time of the beginning of combustion.

Figure 2:
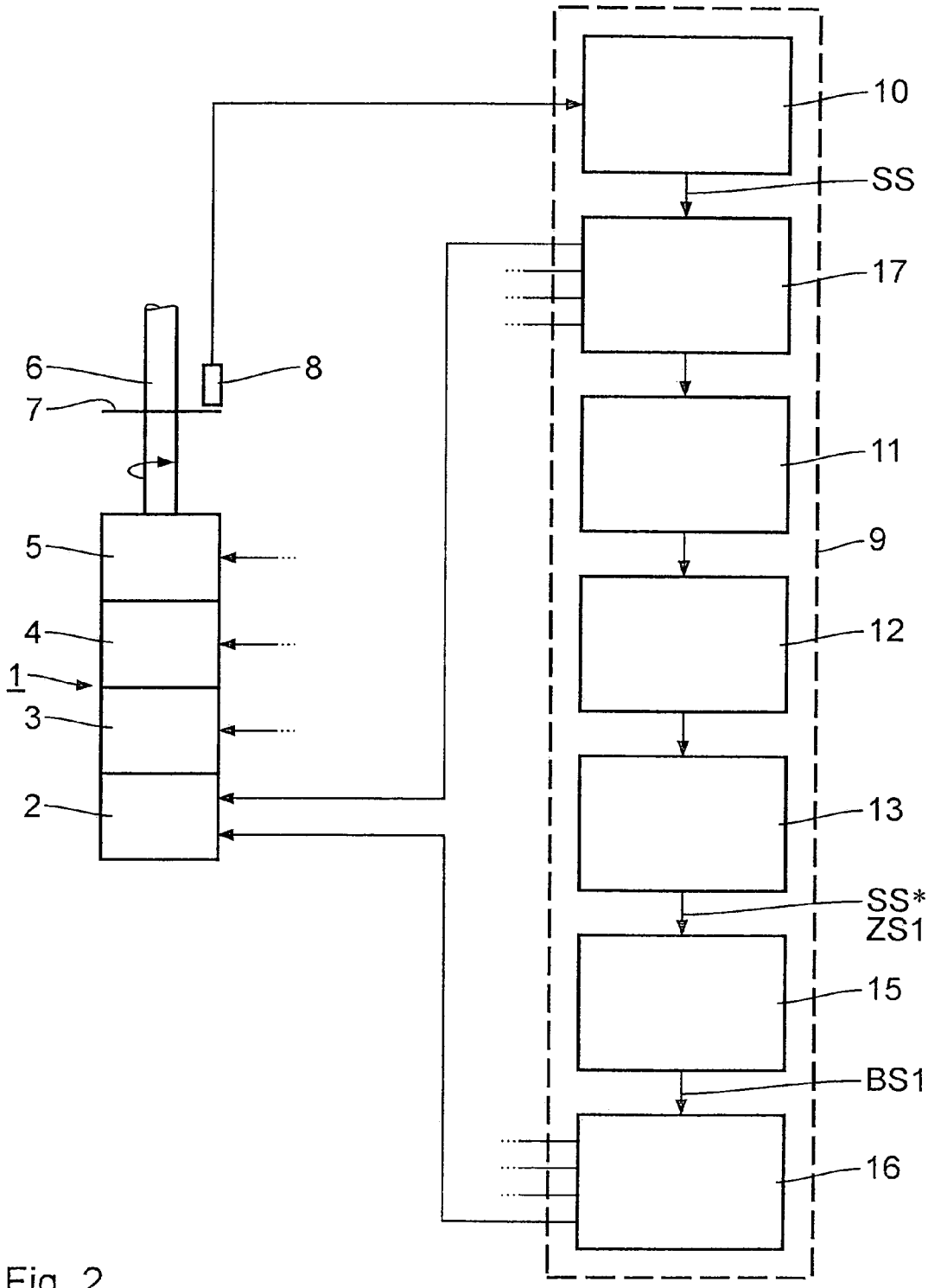

With reference to FIG. 2 a second example of embodiment of the invention is described in the following. Identical elements refer to like reference numerals as is the case with the first example of embodiment, to which description reference is made herewith. The essential difference is the replacement of the segmentation unit 14 by an adjustment unit 17, which in the second example of embodiment is directly connected after the rotation speed unit 10.

The adjustment unit 17 functions substantially to adjust for example the cylinder 2, for which the beginning of combustion is to be currently detected, such that the signal portion caused by the cylinder 2 in the resulting rotation speed signal or segment signal SS, respectively, dominates clearly in relation to those of the other three cylinders 3 to 5. In this case the segment signal SS is practically exclusively determined by the currently relevant cylinder 2. Adjustment of the operational state takes place for example by a targeted increase of the supplied fuel quantity. However, in principle, other adjustment possibilities are also feasible.

Based on the dominance of the signal portion, caused by the adjusted cylinder 2, in the segment signal SS there is no necessity of a further segmentation in the segmentation unit 14 according to the first example of embodiment. The improved segment signal SS* is used as a whole as cylinder signal ZS1. The other method steps proceed analogue to the first example of embodiment, however provided that only for the relevant cylinder 2 a combustion beginning signal BS1 is generated by the analysis unit 15. As a consequence, in this method cycle only the cylinder 2 can be post regulated. For the remaining cylinders 3 to 5 this happens thereafter in sequential chronology. The adjustment unit 17 successively adjusts significantly the operational state in one of the remaining cylinders 3 to 5, respectively. Advantageously, the adjustment unit 17 intervenes only if the internal combustion engine 1 has reached its quasi stationary operational state. This can be easily established by means of the rotation speed signal determined in the rotation speed unit 10 or also by the segment signal SS.

The invention claimed is:

1. A method for detecting the beginning of combustion in an internal combustion engine (1) having several cylinders (2, 3, 4, 5), from a rotation speed signal determined for a shaft (6) of the internal combustion engine (1), in which at least one segment signal (SS), whose signal length corresponds to an integral multiple of one or more full rotations of the shaft (6), is extracted from the rotation speed signal, so that each cylinder (2, 3, 4, 5) ignites one time in the rotation angle range represented by the signal length, a cylinder signal (ZS1, ZS2, ZS3, ZS4), which substantially reproduces the operational state in one of the cylinders (2, 3, 4, 5), is generated from the segment signal (SS), the cylinder signal (ZS1, ZS2, ZS3, ZS4) is transformed into a cylinder frequency signal (FS 1, FS2, FS3, FS4) in an angle frequency range, a signal information indicating the beginning of combustion in the associated cylinder (2, 3, 4, 5) is extracted from the cylinder frequency signal (FS 1, FS2, FS3, FS4) at least one predefined angle frequency with regard to amplitude and phase values associated with the predefined angle frequency, and the beginning of combustion is detected from the signal information.

2. A method according to claim 1, characterized in that the cylinder signal (ZS1, ZS2, ZS3, ZS4) is generated by means of extraction of a partial signal from the segment signal (SS), the partial signal detecting the rotation angle range, within which the concerned cylinder (2, 3, 4, 5) ignites.

3. A method according to claim 1, characterized in that the operational state in the cylinder (2), for which the beginning of combustion is to be detected, is adjusted, and in that the segment signal (SS) resulting from adjustment is used as a whole as the cylinder signal (ZS1) which is significant for this cylinder (2).

4. A method according to claim 1, characterized in that the cylinder frequency signal (FS1, FS2, FS3, FS4) is generated by means of a discrete Hartley-Transformation (DHT) or a discrete Fourier-Transformation (DFT) or by means of digital filtering.

5. A method according to claim 1, characterized in that at least two successive segment signals (SS) are determined arithmetically.

6. A method according to claim 1, characterized in that for generating the rotation speed signal a transmitter wheel (7) is used and that the inaccuracies in the segment signal (SS) resulting from transmitter wheel errors are at least largely eliminated.

7. A method according to claim 1, characterized in that by means of a digital signal processing an improved segment signal (SS*), in particular with a higher scanning rate, is generated.

8. A method according to claim 7, characterized in that the segment signal (SS) is subject to an interpolation method, in particular to a Lagrange- or a sinc-interpolation.

9. A method according to claim 7, characterized in that the segment signal (SS) is subject to a frequency transformation, in particular to a discrete Hartley-Transformation or a discrete Fourier-Transformation.

10. A method according to claim 1, characterized in that the signal information indicating the beginning of combustion is used for regulating the beginning of combustion.

* * * * *

UNITED STATES PATENT AND TRADEMARK OFFICE

CERTIFICATE OF CORRECTION

PATENT NO. : 7,516,732 B2
APPLICATION NO. : 10/587929
DATED : April 14, 2009
INVENTOR(S) : Hagel et al.

It is certified that error appears in the above-identified patent and that said Letters Patent is hereby corrected as shown below:

Title page,
Item (57), ABSTRACT,
Line 3, replace "form" by --from--;
Line 5, after "full", replace "rotation" by --rotations--;
Line 13, after "at", insert --at--;

Column 1,
Line 60, after "predefined", replace "annular" by --angular--;
Line 65, after "As a", replace "measured" by --measurand--;

Column 2,
Line 21, after "accuracy.", insert a paragraph break;

Column 4,
Line 40, after "In this", replace "manners," by --manner,--;

Column 5,
Line 48, after "output at a", replace "fuel-injection" by --fuel injection--;

Column 6,
Line 56, after "at", insert --at--.

Signed and Sealed this

Second Day of November, 2010

David J. Kappos

David J. Kappos
*Director of the United States Patent and Trademark Office*